US008079882B2

(12) United States Patent
Bailey et al.

(10) Patent No.: US 8,079,882 B2
(45) Date of Patent: Dec. 20, 2011

(54) INTERCONNECTING MODULAR HEADERS AND HEADER ASSEMBLIES THEREOF

(75) Inventors: Matthew Bailey, Redford, MI (US); Michael Gonzalez, Lake Orion, MI (US); Christopher Dillon, Springfield Township, MI (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/670,673

(22) PCT Filed: Jul. 16, 2008

(86) PCT No.: PCT/US2008/008663

§ 371 (c)(1),
(2), (4) Date: Jun. 3, 2010

(87) PCT Pub. No.: WO2009/017599

PCT Pub. Date: Feb. 5, 2009

(65) Prior Publication Data

US 2010/0240256 A1 Sep. 23, 2010

Related U.S. Application Data

(60) Provisional application No. 60/952,477, filed on Jul. 27, 2007.

(51) Int. Cl.
*H01R 9/22* (2006.01)

(52) U.S. Cl. ..... 439/717

(58) Field of Classification Search ..... 439/594, 439/717, 701
See application file for complete search history.

(56) References Cited

U.S. PATENT DOCUMENTS 6,375,517 B1 * 4/2002 Okabe et al. ..... 439/701
6,976,887 B2 * 12/2005 Shigeta et al. ..... 439/717
2006/0030222 A1 2/2006 Fan

OTHER PUBLICATIONS

International Search Report for PCT/US2008/008663.

* cited by examiner

*Primary Examiner* — Phuong Dinh
(74) *Attorney, Agent, or Firm* — Larry I. Golden

(57) ABSTRACT

Interconnecting modular connectors or headers have flexible tongue and groove structures for forming a variety of header assembly configurations. The interconnecting modular headers can have locking structures in addition to the tongue and groove mating structures for permanently interlocking the modular headers together. The sidewalls of each modular connector can be parallel to each other and disposed at supplementary angles with respect to the rear wall of the housing. The top wall of each modular connector can have a portion wall extending inwardly from each sidewall at an angle of greater than ninety degrees and each portion wall can have an upwardly extending wall that joins the portion walls to a ceiling. The portion walls can join with the upwardly extending walls to form a T-shape corner. The upwardly extending walls can join with the ceiling equally at an angle of greater than ninety degrees.

23 Claims, 10 Drawing Sheets

FIG.6
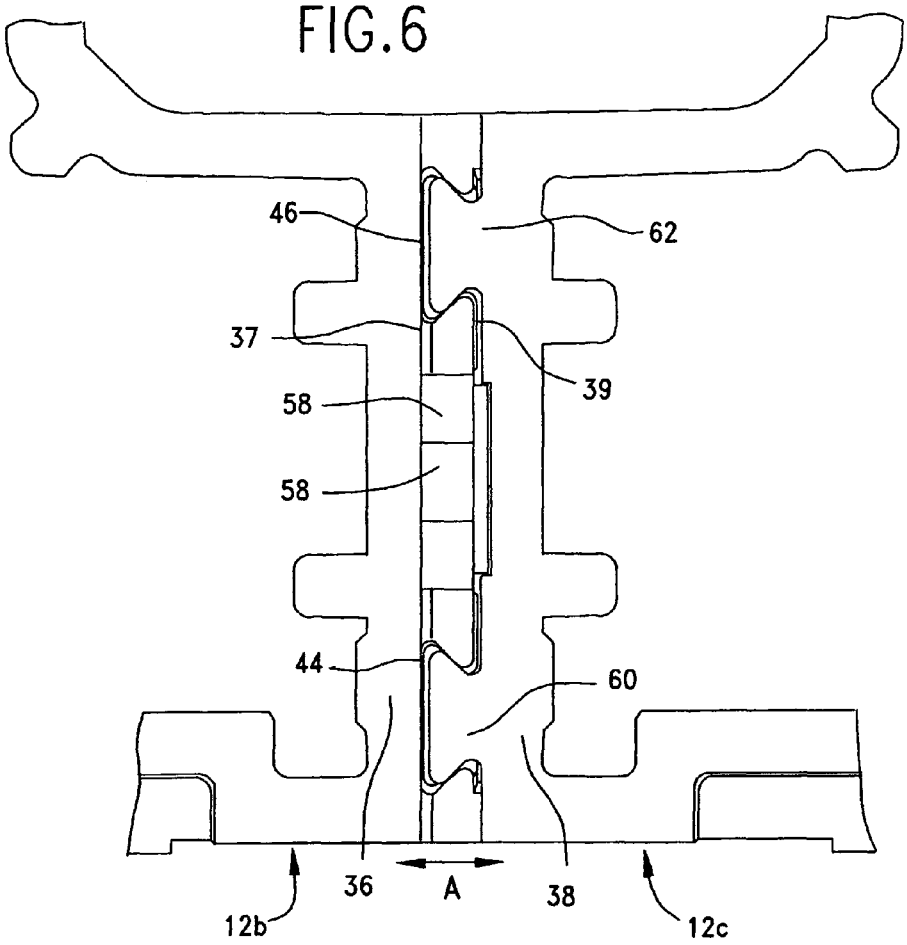
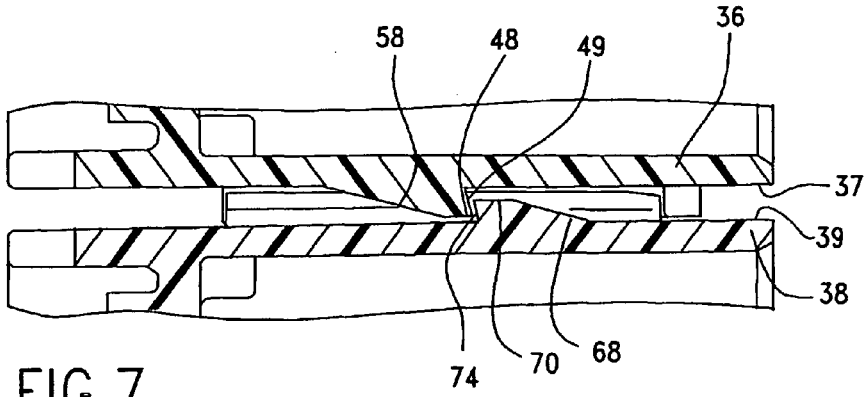
FIG.7

INTERCONNECTING MODULAR HEADERS AND HEADER ASSEMBLIES THEREOF

BACKGROUND OF THE DISCLOSURE

The present disclosure is directed generally to electrical connectors. Specifically, the present disclosure is directed to interlocking electrical connectors for creating modular multi-bay headers. Multi-bay headers have many applications and, in particular, as connector assemblies in the automotive industry. More particularly, the present disclosure is directed to permanently interlocking electrical connectors having flexible engaging members. These new connectors can have housing configurations that can reduce deformation of the header under high temperature conditions and facilitate reduced insertion forces with its mating connector.

Typical currently available multi-bay headers are constructed as a single unitary housing having multiple connector bays. Each connector bay includes contacts or terminals therethrough for connection to a mating connector at one end and to a printed circuit board or other mounting component or connector at another end. There can be disadvantages to such single unitary piece headers. Single unitary piece headers can limit the number of connector bays because molding a single unitary housing having multiple connector bays becomes increasingly complex, especially when the header includes more than one type of connector bay. Interconnected individual modular bays provide flexibility to meet a variety of design applications. As the size of the single unitary piece header increases so does the risk of warping. Also, separate tooling is often needed for every different header configuration. Testing and validation protocols and procedures also must be devised for each new header configuration, and testing and validation then must be conducted for the various header configurations. Additionally, each bay of the multi-bay, single unitary housing header is molded in the same color as the unitary housing. In addition, the sidewalls of single and multi-bay unitary housings usually are configured at draft angles that deviate from ninety degrees for molding or manufacturing purposes resulting in a slightly wider front or rear end. The subsequent side-by-side mounting of these headers form a curve or a smile configuration when viewed from above moving upward on opposite sides in the direction of the narrower side. This can also cause alignment problems for connection between the pins and the PCB. Additionally, the contraction of a multi-bay unitary header connected to a PCB and exposed to high temperatures, can cause bowing of the PCB as shown in FIG. 1A.

Interlocking modular or separate headers, each providing a single connector bay as described herein, can provide advantages in certain instances over current single unitary headers having multiple bays. Single bay headers as described herein can interlock to form a variety of header configurations without requiring new tooling and validation. Many single bay headers can be interconnected to form a header assembly having more bays than may otherwise have been possible with headers having a single unitary housing which face the risk of warping of the large unitary housing. Also, single bay interlocking modular headers can be color-coded to permit quick identification of various qualities or features of the modular header.

In keeping with the present disclosure, interlocking modular headers resist separating after being connected to each other and can even prevent intentional separation of the interlocked headers. Preventing the disengagement of interlocked modular headers can preserve the integrity of modular headers. The interlocked modular headers of the present disclosure also have some degree of flexibility to facilitate locking of the modular headers and alignment of the contacts with the openings in the printed circuit board (PCB) or other mounting component to which the header assembly is mounted. The individual headers and the interlocked header assembly can be devised to resist warping or deformation in elevated heat conditions that can be found during high temperature applications such as soldering or lead-free soldering of the contacts to a PCB and/or within the operating environment of the modular header.

SUMMARY OF THE DISCLOSURE

Other aspects, objects and advantages of the present disclosure will be understood from the following description according to the illustrated embodiments of the present disclosure, specifically including stated and unstated combinations of the various features which are described herein and relevant information which is shown in the accompanying drawings and examples.

An interlocking modular connector for side-by-side locking engagement with another interlocking modular connector is provided. The interlocking modular connector comprises a housing having a front end and a rear end and a receiving cavity defined by a top wall, a bottom wall, a first sidewall, a second sidewall and rear wall. The cavity has an opening positioned at the front end and a connector interface for mating with a complementary mating connector. The first sidewall includes a first locking member and at least one of a tongue and groove having a stop and the second sidewall includes a second locking member and at least one of the other of the tongue and groove having a stop. The sliding engagement of the at least one tongue within the at least one groove of an identical interlocking modular connector such that the at least one tongue contacts the stop of the at least one groove, joins the modular connectors together and engages first and second locking members. The stop halts the progression of the tongue within the groove and prevents sliding disengagement in one direction and engagement of first and second locking members prevents sliding disengagement in the opposite direction to lock the joined modular connectors to each other. The modular connector includes a housing which is color coded based upon its qualities and features. The housing is configured to reduce sagging which can occur during a soldering process and which could otherwise result in binding between the modular connector and mating connector. The housing also has parallel first and second sidewalls.

A plurality of side-by-side interlocked modular connecters for receiving mating connectors is provided. Each modular connector comprises a housing having a front end and a rear end and a receiving cavity defined by a top wall, a bottom wall, a first sidewall, a second sidewall and rear wall. Each cavity has an opening positioned at the front end and a connector interface for mating with a complementary mating connector. Each first sidewall includes a first locking member and at least one of a tongue and groove having a stop and each second sidewall includes a second locking member and at least one of the other of the tongue and groove having a stop. The sliding engagement of each of the at least one tongue within the each of the at least one groove of an adjacent modular connector such that each of the at least one tongue contacts the stop of each of the at least one groove, joins the modular connectors together and engages first and second locking members. Each of the stops halts the progression of each of the tongues within each of the grooves and prevents sliding disengagement in one direction and engagement of each of the first and second locking members prevents sliding disengagement in the opposite direction to lock the joined modular connectors to each other. Each housing is color coded based upon its qualities and features and is configured to reduce sagging which can occur during a soldering process and which could otherwise result in binding between the modular connector and mating connector. Each housing also has parallel first and second sidewalls.

BRIEF DESCRIPTION OF THE DRAWINGS

FIG. 6 is a cross-sectional view of interlocked modular headers of the present disclosure showing the mating of tongues and grooves.

FIG. 7 is a cross-sectional view of interlocked modular headers of the present disclosure showing the locking of opposing ramps.

DETAILED DESCRIPTION OF THE DISCLOSURE

As required, detailed embodiments of the present disclosure are provided herein; however, it is to be understood that the disclosed embodiments are merely exemplary of the disclosure, which may be embodied in various forms. Therefore, specific details disclosed herein are not to be interpreted as limiting, but merely as a basis for the claims and as a representative basis for teaching one skilled in the art to variously employ the inventive features herein disclosed in virtually any appropriate manner.

Figure 1:
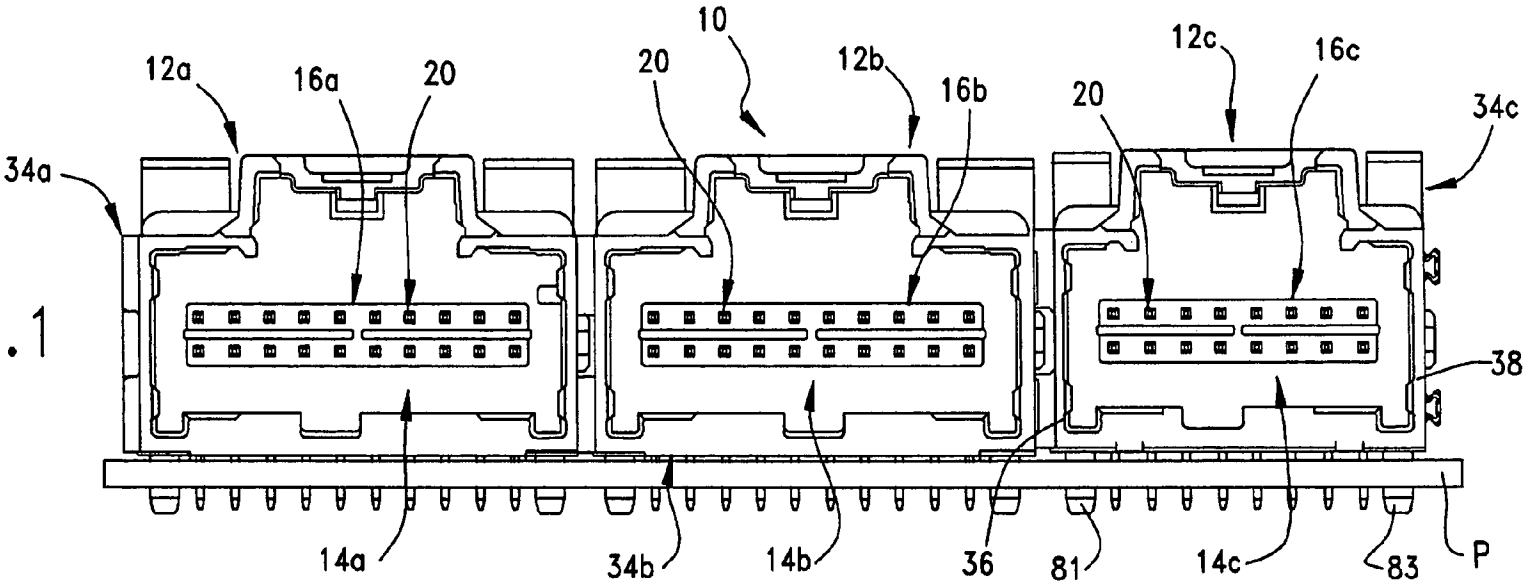
FIG. 1 is an elevation view of one embodiment of a PCB mounted header assembly comprised of interlocking modular headers according to the present disclosure.
Figure 1A:
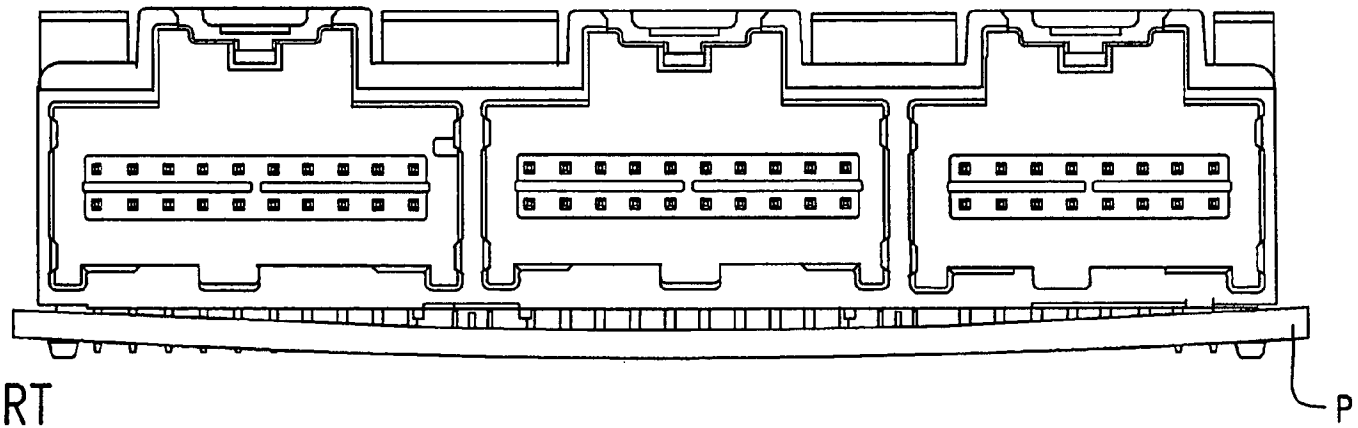
FIG. 1A PRIOR ART
FIG. 1A is an elevation view of a prior art multi-bay unitary header assembly.

FIG. 1 illustrates one embodiment of interlocked modular header assembly 10 of the present disclosure. Header assembly 10 of this embodiment can have two or more (three shown) individual or separate interlocking modular connectors or headers 12*a*, 12*b*, 12*c*, each of which define connector bays 14*a*, 14*b*, 14*c* respectively. Each of connector bays 14*a*, 14*b*, 14*c* can have a connector interface 16*a*, 16*b*, 16*c* and can receive a complementary mating connector "M" (shown in FIGS. 2A, 3A and 3B) therein for mechanical and electrical connection. Connector interfaces 16*a*, 16*b*, 16*c* can have a set of conductive contacts or terminals 20 for power and/or signal transmission. Contacts 20 can be made of practically any conductive material such as metals, metal alloys and/or metal plated materials. Contacts 20 can have various size and shape configurations. Contacts 20 shown in FIG. 1 are constructed of a copper alloy and have a 0.64 mm square cross-section.

Figure 2:
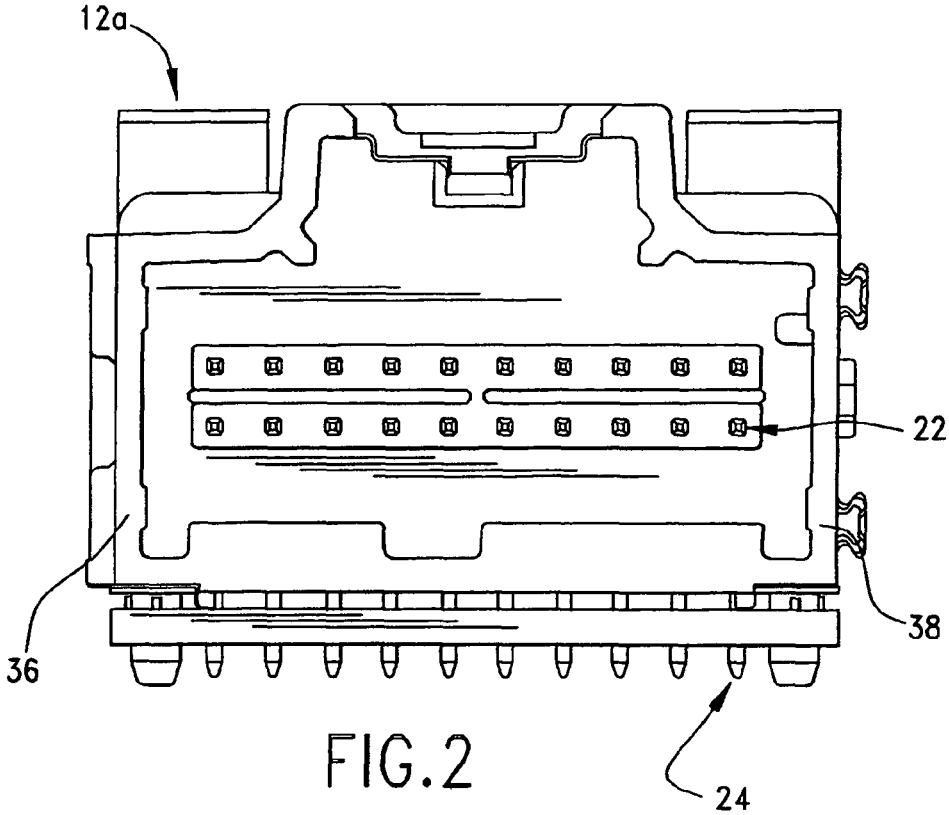
FIG. 2 is an elevation view of one embodiment of an interlocking modular header according to the present disclosure.
Figure 2A:
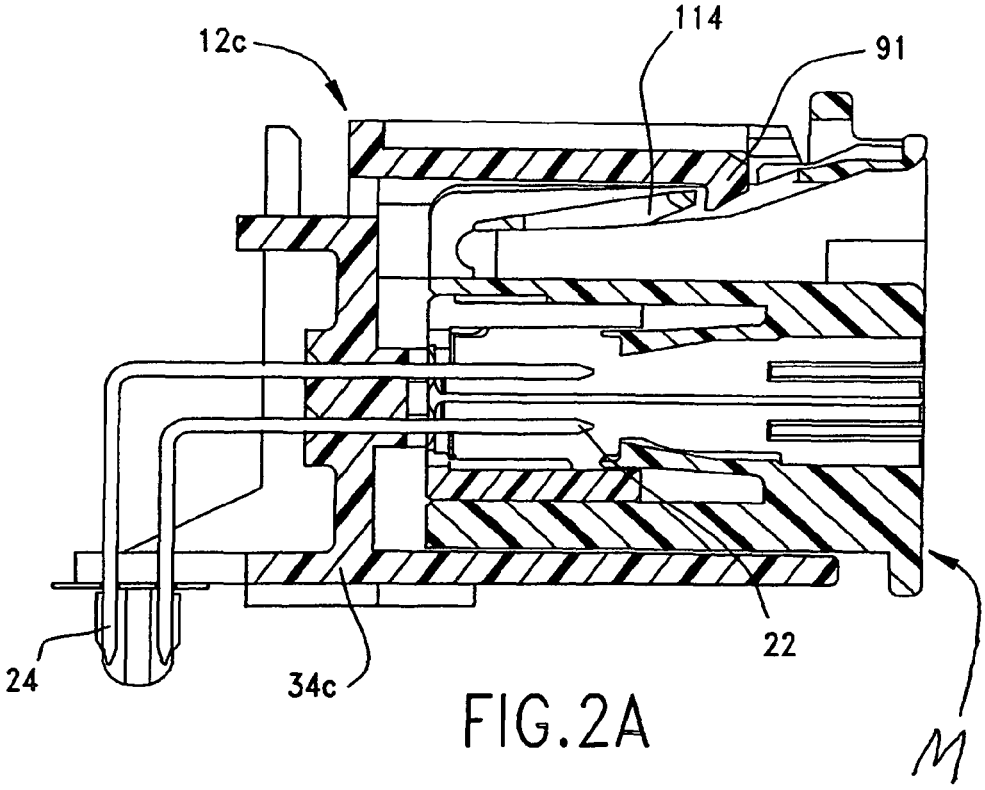
FIG. 2A is a cross-sectional view of the interlocking modular header shown in FIG. 2 with a complementary mating connector.
Figure 3:
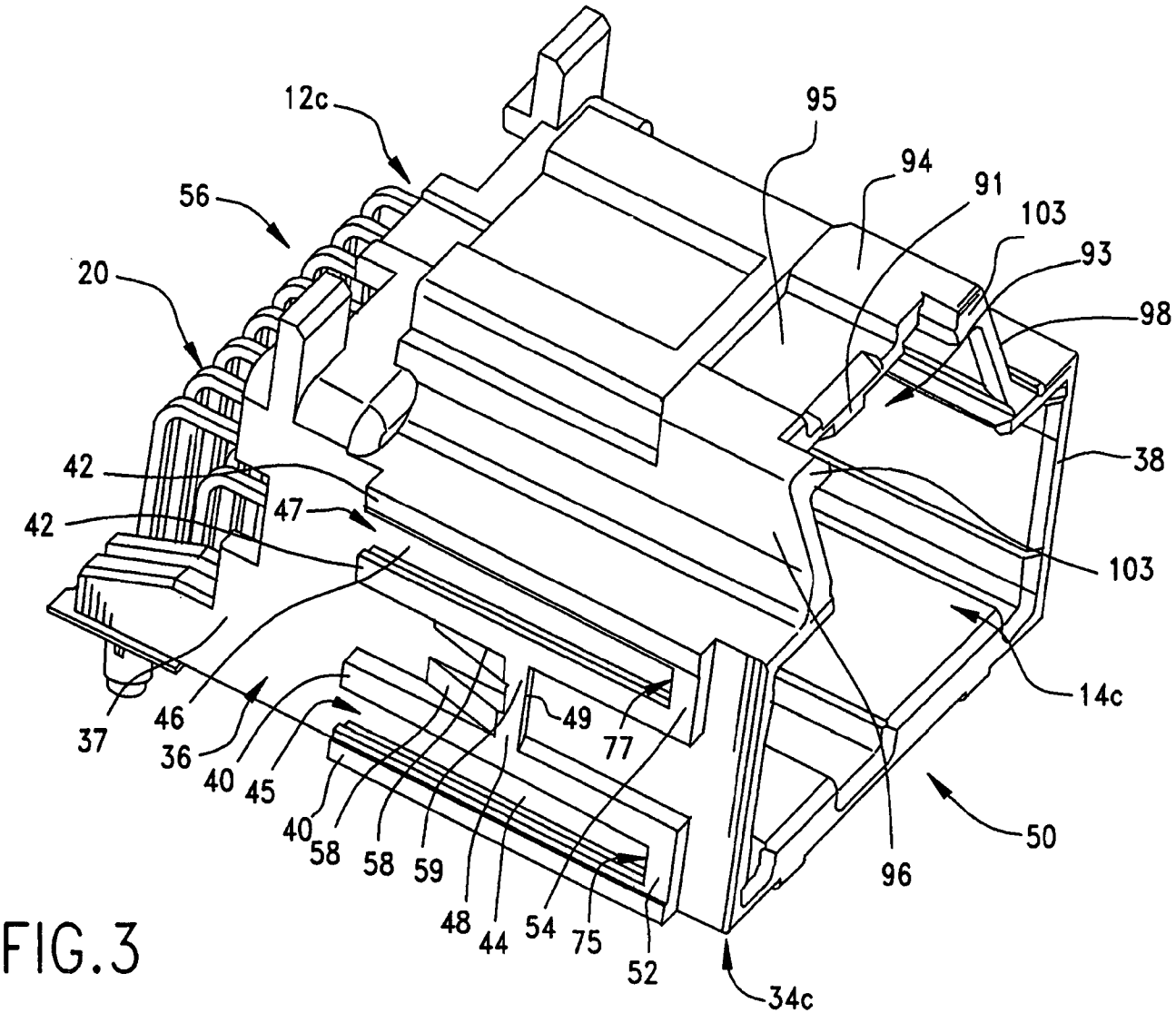
FIG. 3 is a perspective view of a first side of one embodiment of an interlocking modular header according to the present disclosure.

As shown in FIGS. 1, 2, and 2A contacts 20 can have a connector-mating end for mating to a complementary connector "M" and printed circuit board (PCB) end for connection to PCB "P" or the like or to another connector. Contacts 20 of interlocking modular headers 12*a*, 12*b*, 12*c* can have connector-mating end 22 and PCB end 24 disposed at a right angle as shown in FIGS. 2, 2A and 3 or can be disposed in a straight line or linear fashion (not shown). PCB end 24 of contacts 20 can have a compliant pin member for attachment to a PCB without the need for soldering. Headers may also be secured to the PCB by a through-hole solder tail or by a conventional surface mount. Interlocking modular headers 12*a*, 12*b* are illustrated to have twenty contacts 20 and modular header 12*c* is illustrated to have sixteen contacts 20 and can respectively be referred to as 20-Circuit Right-Angle Headers or a 16-Circuit Right-Angle Header.

Figure 4:
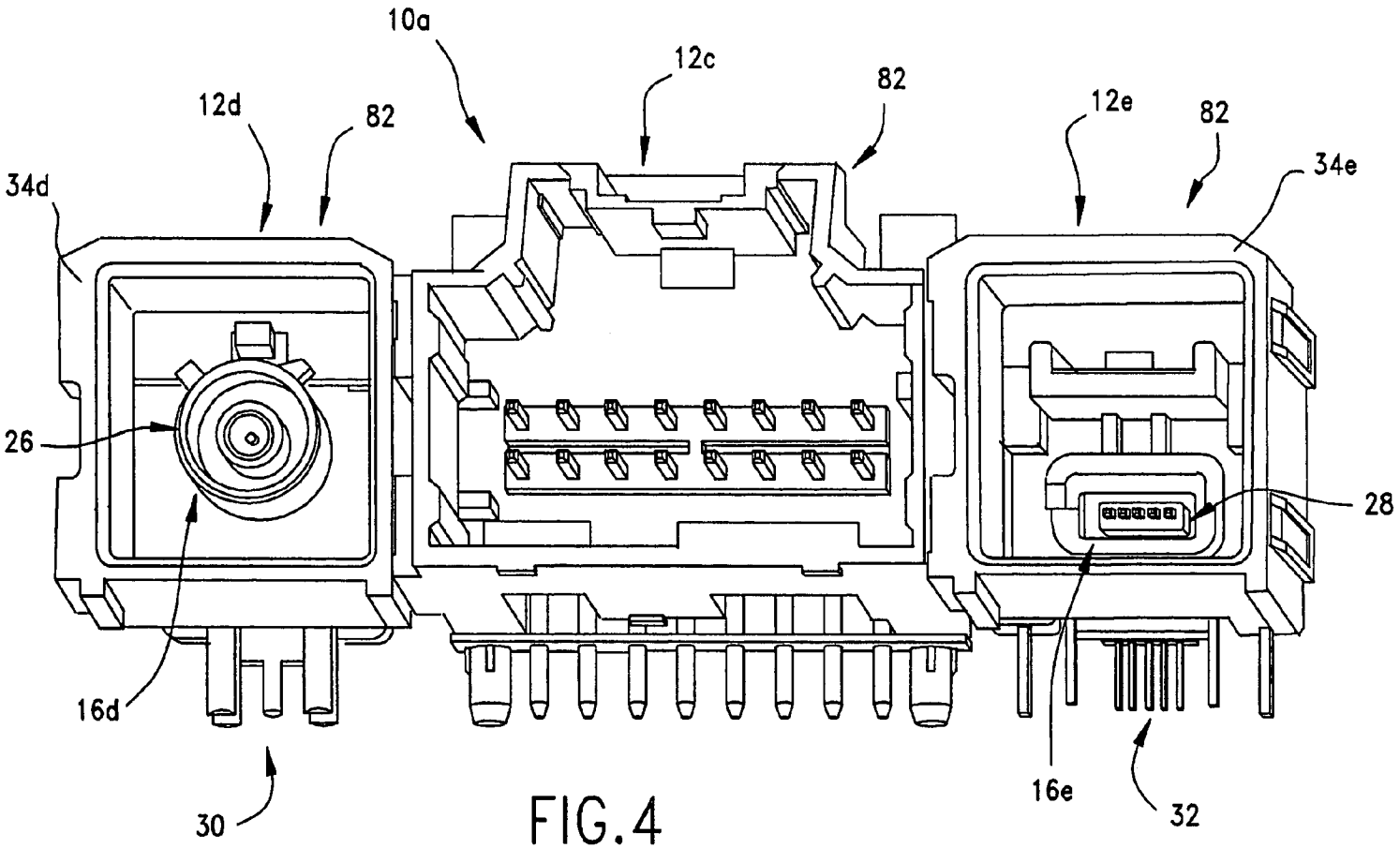
FIG. 4 is a perspective view of another embodiment of a header assembly comprised of interlocking modular headers according to the present disclosure.

The connector bays of the interlocking modular headers of the present disclosure can have a variety of connector interfaces besides the illustrated twenty-contact or sixteen-contact arrangements. As illustrated in FIG. 4, another embodiment of interlocked modular header assembly 10*a* of the present disclosure has interlocking modular header 12*d* that has RF connector interface 16*d* and interlocking modular header 12*e* that has USB connector interface 16*e*. Although not shown in the drawings, fiber optic connector interfaces can also be used with interlocking modular headers of the present disclosure. These interfaces may or may not all directly interface with the PCB, but rather can interface with other interconnection systems. The connector interfaces of interlocking modular headers 12*d*, 12*e* can have connector-mating ends 26, 28 and PCB end 30, 32, respectively disposed at a right angle as shown in FIG. 4 or alternatively disposed in a straight line or linear fashion (not shown).

Headers available heretofore consist of a single unitary housing having one or more connector bays for connection to mating connectors. With each change in either the number of connector bays or type of connector interfaces required for a particular application, a new header construction would be required. In some instances, unitary housing multi-bay headers are used inefficiently by utilizing less than all the bays of the header instead of acquiring a new multi-bay unitary housing header having only the number of bays actually needed for the application because of the extra time and expense to effect the change. Also, side-by-side mounting of individual or multi-bay unitary housing headers having standard sidewall draft angles results in a curving effect of the connected headers which can cause alignment problems between the pins carried by the headers and the receiving holes or other mounting feature in the PCB.

With interlocking modular headers of the present disclosure, a header or header assembly can be constructed by securely engaging one or more interlocking modular headers having a desired connector bay arrangement depending on the desired application. Modular headers 12*a*, 12*b*, 12*c*, 12*d*, 12*e* can be interlocked in any combination depending on the desired application and can conform to various standards. For example, all modular headers 12*a*, 12*b*, 12*c*, 12*d*, 12*e*, can find application in the automotive industry for power and/or signal transmission. Additionally, headers 12*a*, 12*b*, 12*c* can also meet specific industry standards, such as USCAR connector standards.

Housings 34*a*, 34*b*, 34*c*, 34*d*, 34*e* of interlocking modular headers 12*a*, 12*b*, 12*c*, 12*d*, 12*e* respectively can have interlocking connecting structures on sidewalls for connecting or permanently locking headers to one another and can be designed to have sidewalls disposed parallel to each other and disposed at surface angles other than ninety degrees with respect to the rear wall 80. The description that follows for the interlocking structures and surface angles of interlocking modular header 12*c* is equally applicable to interlocking modular headers 12*a*, 12*b*, 12*c*, 12*d*, 12*e* even though headers 12*a*, 12*b*, 12*d*, 12*e* can have different connecter interfaces 16*a*, 16*b*, 16*d*, 16*e* and different housing coloration. Other housing structures such as particular mating and/or keying structures can be use specific. Mating structures allow the interlocking modular header to mate only with the appropriate complementary connector. It will be appreciated that each modular header 12*a*, 12*b*, 12*c*, 12*d*, 12*e* can have different mating structures depending on its intended application.

Figure 5:
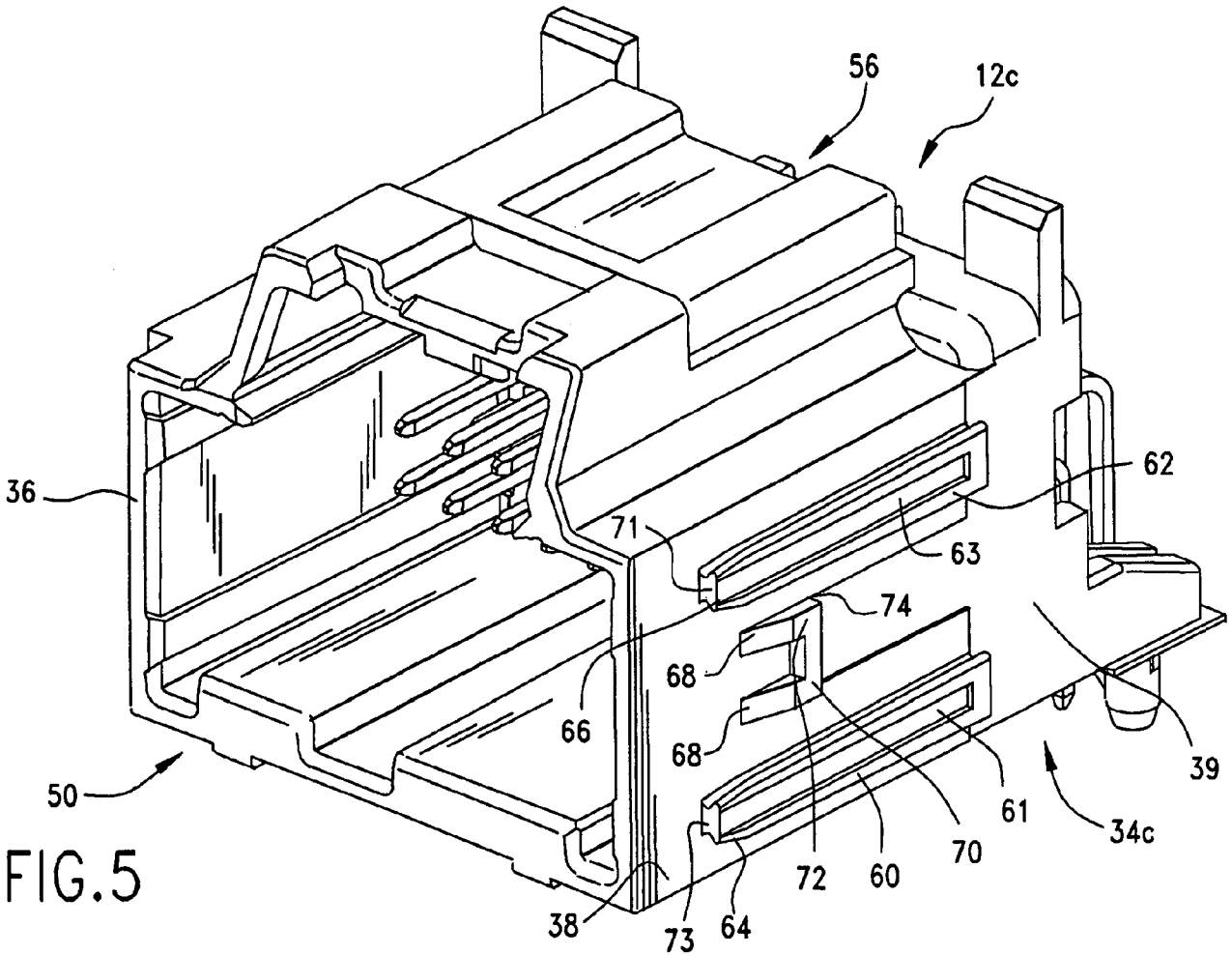
FIG. 5 is a perspective view of the opposite side of the interlocking modular header shown in FIG. 3.

As shown in FIGS. 3 and 5, housing 34*c* of modular header 12*c* can have longitudinally extending sidewalls 36, 38 that are laterally spaced apart from and disposed generally in parallel relation to each other. Sidewalls 36, 38 extend in a longitudinal direction from front end 50 towards rear end 56 of housing 34*c*. Housing 34*c* can be constructed of a dielectric material such as plastic and the like. Housing 34*c* can also have a specified color that corresponds to one or more qualities and/or features of the modular header 12*c*, such as connector-interface type, contact type, number of contacts, and mating and/or keying structures. It is understood that the housing for each modular header can be readily manufactured to have a unique color based upon one or more qualities and/or features.

For interlocking the modular headers, the sidewalls can have tongue and groove structures. As shown in FIG. 3, sidewall 36 can have lower pair of rails 40 and upper pair of rails 42 extending longitudinally along outer surface 37 of sidewall 36. Two rail pairs 40, 42 can be positioned generally offset from the longitudinal center of sidewall 36 towards front end 50 and can extend from about thirty percent to the entire longitudinal length of the sidewall.

Individual rails of rail pair 40 can be spaced apart from each other to form groove 44 and individual rails of rail pair 42 are spaced apart to form groove 46. Alternatively, one pair of rails can be used to form a single groove. Pairs of rails 40, 42 (shown in a horizontal orientation in the drawings) can be spaced apart from each other and joined by crossbar 48 (shown in vertical orientation in the drawings) which can be disposed generally perpendicular to rail pairs 40, 42. Vertically oriented crossbar 48 can be positioned generally midway along the length of the rail pairs 40, 42. Crossbar 48 can have locking face 49 facing front end 50 of housing 34*c*. Locking face 49 can function as a component of interacting members that enable the locking of modular headers to each other.

The ends of individual rails 40 and of individual rails 42 nearest to mating-connector end 50 of housing 34*c* can be joined by rail bars 52, 54 respectively (shown in vertical orientation in the drawings). As such, grooves 44, 46 can be closed at front end 50 by rail bars 52, 54 respectively and open toward rear end 56 of housing 34*c*. When desired, rail bars 52, 54 can be toward rear end 56 in which event grooves 44, 46 typically would be open toward front end 50. Rail bars 52, 54 function as stops to halt the progress of interlocking or mating tongues 60, 62 discussed below through grooves 44, 46. Accordingly, it will be understood that one rail bar can be used instead of two. In addition, instead of rail bars 52, 54, individual rails of rail pairs 40, 42 can converge to define tapering grooves to halt the progression of tongues 60, 62 through the grooves 60, 62. It will be understood that these and other arrangements to halt the progression of tongues 60, 62 through grooves 44, 46 are within the scope of the disclosure.

Between rail pairs 40, 42 can be spaced apart ramps 58, a pair being shown. Alternatively, a single ramp or more than two ramps can be utilized. Ramps 58 can rise from outer face 37 of sidewall 36 as they extend in a direction from rear end 56 of housing 34*c* towards front end 50 of housing and terminate at top surface 59 of crossbar 48 when the rail bars 52, 54 are positioned towards the front end 50 of housing 34*c*. If the rail bars 52, 54 are positioned towards rear end 56, ramps 58 can rise from outer surface 37 of sidewall 36 as they extend in a direction from front end 50 towards rear end 56.

Ramps 58 can each have an equal slope of from about 1 to about 45 degrees, preferably 10 to 30 degrees. Ramps shown in FIG. 3 have a slope of about 15 degrees. Ramps 58 can typically extend from about ten percent to about forty percent the longitudinal length of the rails 40, 42, and extend about twenty-five percent in the illustrated embodiment.

Figure 9:
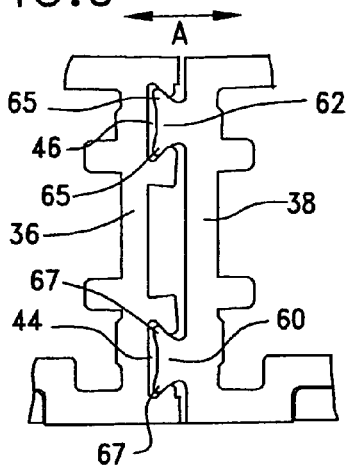
FIG. 9 is a cross-sectional view of interlocked modular headers of the present disclosure showing the flexibility of the tongue and groove mating during lateral separating movement in direction A.

Turning now to FIG. 5, opposing outer surface 39 of sidewall 38 can have lower tongue 60 and upper tongue 62 extending along outer surface 39 in a longitudinal direction from front end 50 towards rear end 56. Tongues 60, 62 are positioned on sidewall 38 and dimensioned such that tongues 60, 62 will mate with grooves 44, 46, respectively of an adjacent interlocking modular header. Alternatively, a single tongue can be used to mate with a single groove or each sidewall can have both a tongue and groove to mate with a complementary tongue and groove on an opposite sidewall. The mating of tongues 60, 62 on modular header 12*b* with grooves 44, 46 of modular header 12*c* is shown in FIG. 6. As can be seen in FIG. 6, tongues 60, 62 and grooves 44, 46 can have a dove-tail cross-section to provide greater flexibility of lateral motion shown by arrows "A" and "B" in FIGS. 6, 9, and 10. Additionally, tongues 60, 62 can each have central depressions 61, 63, respectively. Each depression 61, 63 can act as a hinge to flared ends 65, 67 of each tongue 60, 62 respectively as shown in FIG. 9. This structure can increase flexibility of interlocked headers.

Tongues 60, 62 can have tapered ends 64, 66 respectively, positioned towards front end 50 to facilitate entry of tongues 60, 62 into grooves 44, 46, respectively. If desired, tapered ends 64, 66 can be positioned at the opposite end of tongues 60, 62 (opposite from that shown in FIG. 5.) towards rear end 56 when rail bars 52, 54 are positioned at opposite ends of the rails 40, 42 towards rear end 56 (opposite from that shown in FIG. 3).

As illustrated by the embodiment in FIG. 5, generally midway between tongues 60, 62 can be multiple spaced apart ramps 68, two ramps being shown, joined by crossbar 70. Alternatively, a single ramp can be utilized. Ramps 68 can rise from outer face 39 of sidewall 38 as they extend in a direction from front end 50 of housing 34*c* towards rear end 58 of housing and terminate at top surface 72 of crossbar 70 when tapered ends 64, 66 are positioned towards the front end 50 of housing 34*c*. If tapered ends 64, 66 are positioned towards rear end 56, ramps 68 can rise from outer surface 37 of sidewall 36 as they extend in a direction from rear end 56 towards front end 50.

Facing the rear end side of housing 56, crossbar 70 can have locking surface 74 which engages locking surface 49 of groove side of the housing to prevent unlocking of locked modular headers. Ramps 68 and crossbar 70 and ramps 58 and crossbar 48 can be dimensioned and positioned relative to each other on outer surfaces 39, 37, respectively such that when tongues 60, 62 of one modular header are fully inserted into grooves 44, 46 of another modular header, a substantial portion of each of locking surfaces 74, 49 is in contact with each other as shown in FIG. 7. These substantial portions of contact typically will encompass at least a majority of each surface to ensure secure locking.

The ramps can each have an equal slope of from about 1 to about 45 degrees, typically from about 10 to about 30 degrees. Ramps shown in FIG. 3 have a slope of about 15 degrees. Ramps 68 can extend about the same distance longitudinally along outer surface 39 of side wall 38 as ramps 58 on outer surface 37 of sidewall 38.

Referring now to FIGS. 3 and 5, the interlocking of modular headers of the present disclosure will be described. While FIGS. 3 and 5 illustrated sidewalls 36 and 38 of a single modular header 12*c*, the same FIGS. 3 and 5 will be referenced as if each illustrated two separate but identical modular headers 12*c*. It will be appreciated that this description of the interlocking of modular headers 12*c* also applies to the interlocking of any of the other modular headers 12*a*, 12*b*, 12*d*, 12*e* to each other and to modular header 12*c* since they all can have the same or similar interlocking structures.

Figure 8:
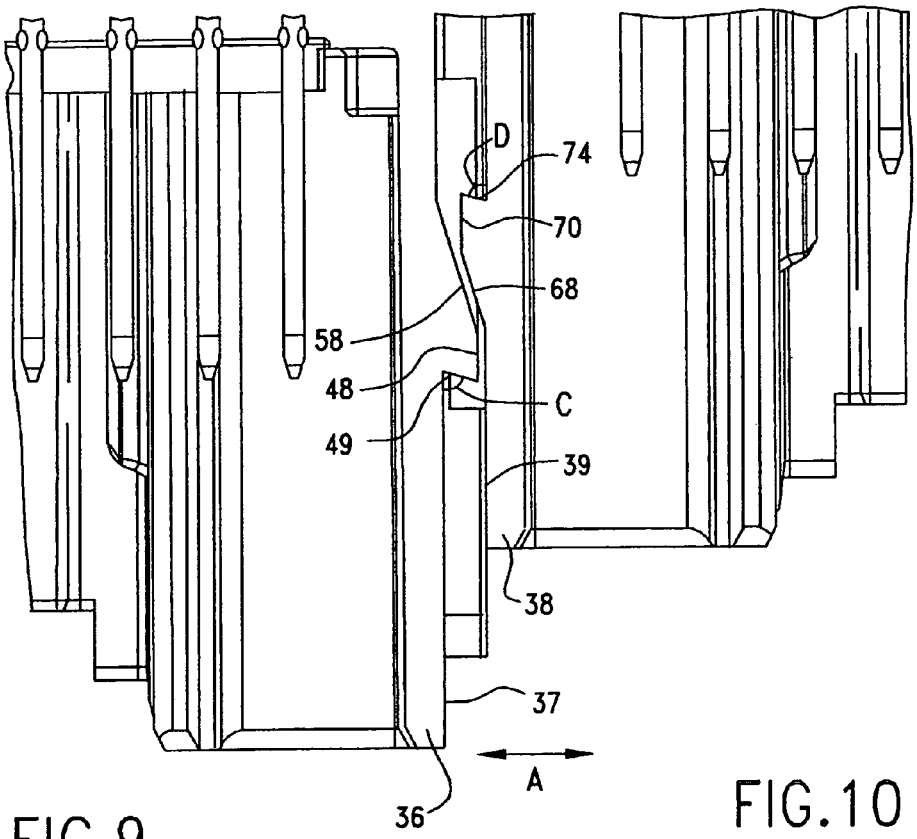
FIG. 8 is a cross-sectional view of interlocked modular headers of the present disclosure showing the sliding engagement of opposing ramps prior to locking.

Modular headers 12*c* are brought together such that sidewall 38 is adjacent sidewall 36 with front end 50 of one modular connector 12*c* adjacent to the rear end 56 of the other modular connector 12*c*. Modular headers 12*c* are then moved toward each other (longitudinally with respect to one another as shown in FIGS. 3 and 5) such that tapered ends 64, 66 of tongues 60, 62 respectively are passed through openings 45, 47 of grooves 44, 46, respectively. As tapered ends 64, 66 slide through their respective grooves 44, 46 and approach rail bars 52, 54 respectively, ramps 58, 68 engage, as shown in FIG. 8, and slide past each other. The rising ramps 58, 68 force sidewalls 36, 38 to separate or move laterally with respect to one another as shown by arrows "A" in FIG. 8. Since a portion of each tongue 60, 62 is inside respective grooves 44, 46, this lateral separation is resisted.

However, as shown in FIG. 9, the dovetail shape of the cross-section of tongues 60, 62 and grooves 44, 46 and hinged flares 65, 67 can allow lateral flexing and separation of sidewalls 36 and 38 to allow some degree of freedom of movement between modular headers after assembly together and during, for example, placement onto a PCB. This flexing also can facilitate sliding of ramps 58, 68 past each other. In addition, this degree of freedom of movement can successfully address warping issues of a PCB to which the interlocked modular headers are attached. This overcomes one shortcoming of unitary housing multi-bay headers which can be generally caused by the elevated temperature created during the soldering process to fix the contacts of the header to a PCB board combined with differing degrees of thermal expansion between the unitary housing and the PCB board.

Modular headers 12*c* are then brought together longitudinally until faces 71, 73 of respective tapered ends 64, 66 (shown in FIG. 5) contact inner surfaces 75, 77 of respective rail bars 52, 54 (shown in FIG. 3) at which point further continued longitudinal movement is halted. This also can be the point at which crossbars 48, 70 pass each other. Longitudinal movement in the opposite direction of the joining process is prevented by locking surface 49 engaging locking surface 74 as shown in FIG. 7. The locking of modular headers 12*c* is permanent in that modular headers 12*c* cannot be separated without damaging one or both modular headers 12*c*. In addition, ramps 58, 68 can be positioned near the center between groove 44, 46 and tongues 60, 62 respectively to limit their accessibility and prevent any attempt to disengage the interlocked modular headers.

Figure 10:
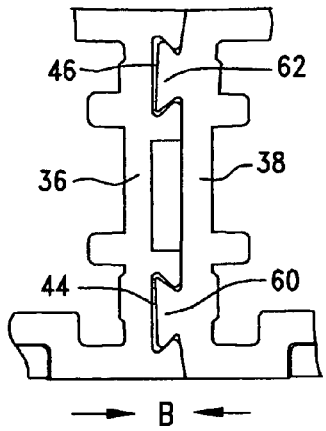
FIG. 10 is a cross-sectional view of interlocked modular headers of the present disclosure showing the flexibility of the tongue and groove mating during lateral compressive movement in direction B.

Compressing the modular headers 12*c* together in a lateral direction shown by arrows "B" in FIG. 10 can be facilitated by the dovetail cross-sectional shape of tongues 60, 62 and grooves 44, 46. Lateral movement in the "A" and "B" directions may be required when mounting the modular headers of the present disclosure to a PCB or other mounting component since the contacts 20, 30, or 32, depending on the modular header, may not be perfectly aligned with receiving holes in the PCB or other mounting component.

To improve the locking of modular header 12*c* the angle "C" between locking surface 49 and outer surface 37 of sidewall 36 can be less than ninety degrees as shown in FIG. 8. Angle "C" can be from about forty-five to about eight-nine degrees, typically about eighty-five degrees, as shown in FIG. 8. Angle "D" between locking surface 74 and outer surface 39 of sidewall 38 can also be less than ninety degrees and typically the same as angle "C".

It will be understood that the relative positioning of faces 71, 73 (shown in FIG. 5) of respective tongues 60, 62 to inner surfaces 75, 77 (shown in FIG. 3) of respective rail bars 52, 54 can control the longitudinal alignment of interlocked modular headers. Also, the relative positioning of locking surface 49 to inner surfaces 75, 77 and the relative positioning of locking surface 74 to faces 71, 73 can affect whether locking surfaces 49, 74 will engage prior to or at the same time as the movement of tongues 60, 62 through grooves 44, 46 is stopped by rail bars 52, 54, and whether additional continued movement in the same direction will be permitted.

As indicated above, grooves 44, 46, ramps 58, 68 and tongues 60, 62 are illustrated as extending longitudinally in a direction from front end 50 toward rear end 56 with the ramps 58, 68 disposed in opposite orientation and crossbars 48, 70 extending perpendicular to grooves 44, 46 and tongues 60, 62, respectively. It will be understood, that grooves 44, 46, ramps 58, 68 and tongues 60, 62 can also be made to extend in a direction perpendicular from that shown in FIGS. 3 and 5, or in other words, in a direction from bottom wall 78 towards top wall 82 or in any directional orientation therebetween.

The surface angles of sidewalls 36 and 38 will now be described. These surface angles are part of the present design to enhance functioning of the headers, particularly upon and after assembly. The nature of the side walls forming a parallelogram shape is not typical in standard molding practices. By designing and manufacturing the side walls of each connector to be parallel, multiple connectors can be stacked together and maintain the linear position of the mounting posts and terminals with respect to the PCB with which it will be connected. Typically, standard molding procedure dictates that molds include a draft angle. The purpose of a draft angle is to first provide release from the cavity side of the mold upon tool opening. Then, upon ejection, draft allows instant release of the plastic part without dragging. If plastic parts have right angle walls, drag marks will occur on the plastic as it scrapes along the metal tool face. Additionally, there exists the possibility that the plastic part can get stuck in the mold causing the mold to break and disrupt production. The standard mold process which includes a draft angle produces components that have a larger base portion that tapers to a smaller top portion, the cross section of such parts having a trapezoidal shape.

Multiple parts molded under the standard mold process and arranged in a side by side manner do not align with each other in a full surface to surface contact arrangement. While these parts have respective base portions with surface to surface engagement, due to the tapered sides of these parts, their respective top portions tend to be spaced apart due to the nature of the draft angle on each adjacent tapered side wall. Therefore, as the number of individual components in the side by side arrangement increases, the amount of misalignment also increases. In applications where these modular stacked connectors are fixed to base structures, for instance circuit board substrates, such misalignment raises difficulties for connection of the stacked connectors to the circuit board.

Figure 11:
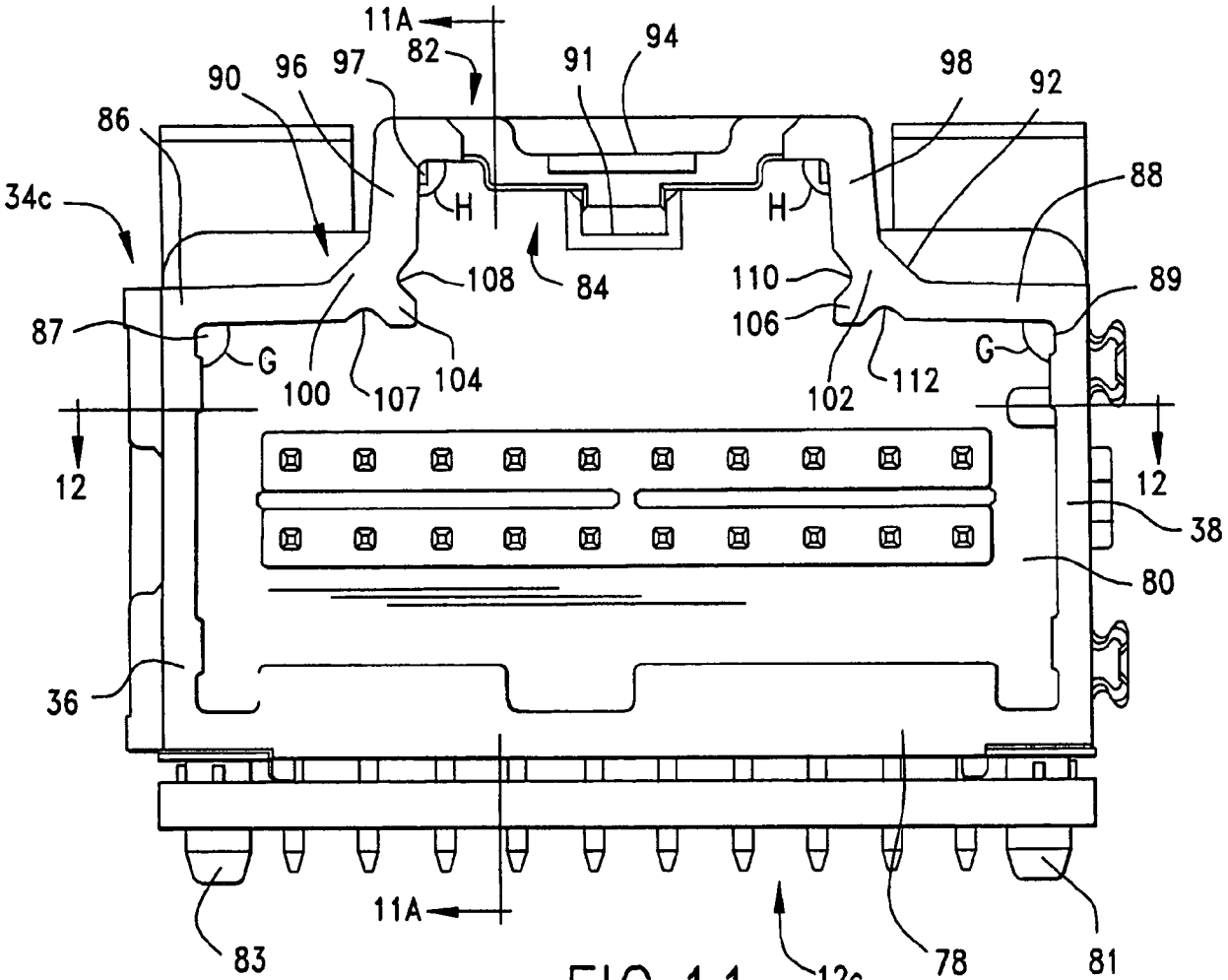
FIG. 11 is a front elevation view of the modular header shown in FIG. 3.

Referring to FIG. 11, housing 34*c* can have opposing and parallel sidewalls 36, 38. Sidewalls 36, 38 can be joined by base or bottom wall 78. Bottom wall 78 can have posts or through-hole solder tails 81, 83 to assist in securing the modular header to a PCB. Posts 81, 83 can extend in the same direction as PCB end 24 of contact 20. Accordingly, if contact ends 22, 24 are linearly disposed, the posts would likewise extend linearly from housing 34*c*. Sidewalls 36, 38 extend upwards and can be disposed generally perpendicular to bottom wall 78. Back or rear wall 80 can extend generally perpendicularly from bottom wall 78 and can also join sidewalls 36, 38. To wall 82 can extend generally perpendicular from back wall 80 and join sidewalls 36, 38.

Figure 12:
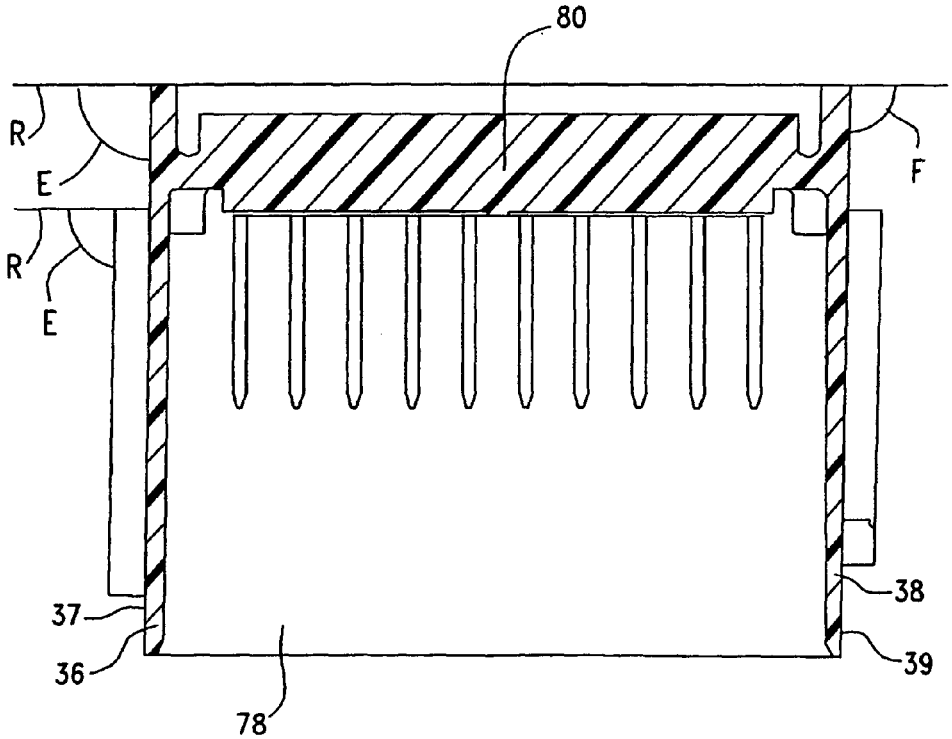
FIG. 12 is a cross-sectional view taken at line 12 shown in FIG. 11.

As shown in FIG. 12, sidewall 36 can be joined to and can extend from rear wall 80. Outer angle "E" measured from outer surface 37 of sidewall 36 to plane "R" which extends parallel to rear wall 80 can be less than ninety degrees; typically, outer angle "E" can be from about eighty-five to about less than ninety degrees, typically from about 88 to about 89.8 degrees. In an explicitly illustrated embodiment, outer angle "E" can be about eighty-nine degrees. Sidewall 38 can be joined to and can extend from rear wall 80. Outer angle "F" measured from outer surface 39 of sidewall 38 to plane "R" can be greater than ninety degrees by the same amount outer angle "E" is less than ninety degrees in order for sidewall 36 to remain parallel to sidewall 38. In other words, outer angles "E" and "F" can be supplementary angles. Accordingly, outer angle "F" can be from about greater than ninety degrees to about ninety-five degrees, typically from about 90.2 to about 92 degrees. In a particularly illustrated embodiment, outer angle "F" can be about ninety-one degrees. Top wall 82 and bottom wall 78 can be configured to accommodate the surface outer angles "E", "F" and can have the general shape of a parallelogram having no right angles. Sidewalls 36 and 38 necessarily form respective supplementary inner angles to plane "R" with respect to the outer angles "E" and "F".

As shown in FIG. 11, top wall 82 can have raised ceiling 84 which may not be present in modular headers 12*d*, 12*e* as shown in FIG. 4. Top walls 82 of modular headers 12*a*, 12*b*, 12*c* can also have raised ceiling 84. Top wall 82 can have two portion walls 86, 88 extending inwardly from sidewalls 36, 38, respectively. Portion walls 86, 88 meet sidewalls 36, 38 respectively at angle "G" which can be greater than ninety degrees. Angle "G" can be from about greater than ninety degrees to about one-hundred thirty-five degrees and typically about ninety-three degrees. Sidewalls 36, 38 can have grooves 87, 89, respectively adjacent the interface with portion walls 86, 88 respectively as shown in FIG. 11.

Portion walls 86, 88 join raised ceiling 84 at corner portions 90, 92 shown in FIGS. 11 and 3. Raised ceiling 84 can have cap portion 94 and can be parallel to bottom wall 78. Raised ceiling 84 can have upstanding walls 96, 98 that can extend from opposite ends of cap portion 94 and can join portion walls 86, 88 respectively. Upstanding walls 96, 98 meet cap portion 94 at angle "H" which can be greater than ninety degrees. Angle "H" can be from about greater than ninety degrees to about one-hundred thirty-five degrees and typically about ninety-three degrees.

Figure 13:
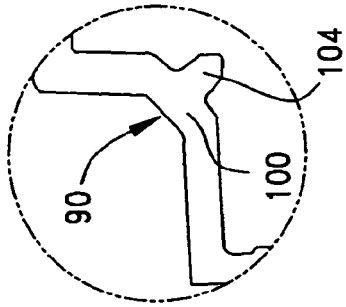
FIG. 13 is a front elevation view of the T-shaped corner area shown in FIG. 11.

Referring to FIGS. 11 and 13, upstanding walls 96, 98 of raised ceiling 82 can intersect with portion walls 86, 88 respectively to form corner areas 90, 92. Corner areas 90, 92 can form an approximate T-shape. Approximate T-shaped corner areas 90, 92 can have slanted walls 100, 102 and generally centrally positioned ribs 104, 106 respectively that can extend longitudinally along the entire length of slanted walls 90, 92, respectively. Ribs 104, 106 can extend generally perpendicularly from slanted walls 100, 102, respectively. As shown in FIG. 13, the front face of slanted wall 100 and rib 104 can form an approximate T-shape as viewed from the mating end of the connector or in a cross-section taken through housing 12*c* by a plane parallel to rear wall 80. Alternatively, approximate T-shaped corner areas 90, 92 can have grooves 107, 108 and grooves 110, 112, respectively extending the entire longitudinal distance of corner areas 90, 92. Grooves 107, 112 can be positioned adjacent portion walls 86, 88 respectively and grooves 108, 110 can be positioned adjacent upstanding walls 96, 98, respectively. Grooves 106, 108 and grooves 110, 112 can define ribs 104, 106 respectively.

This approximate T-shape configuration of corner areas 90, 92 helps to prevent downward dropping or sagging of ceiling 82 when modular header 12*c* is subjected to the elevated temperatures typically encountered during the lead-free solderless joining of contacts 20 to a PCB that would otherwise occur if upstanding walls 96, 98 joined portion walls 86, 88, respectively, at a sharp corner. Angles "G" and "H" also contribute to prevent sagging of the ceiling that may otherwise occur if angles "G" and "H" were at right angles. This designed in clearance provided by angle "G" and "H" being greater than ninety degrees helps to avoid binding between the housing and the complementary connector which could otherwise occur as a result of exposure of the housing to elevated temperatures such as during lead-free solder process.

Cap portion 94 can have hook 91 extending into connector bay 14*c* for engagement with a biasing catch member for releasably retaining a mating connector to modular header 12*c* as shown in FIGS. 2A and 3. Cap portion 94 can have a cutout portion 93 or, in other words, a center area 95 of cap portion 94 having a hook 91 which does not extend out to front faces 103 of upstanding walls 96, 98. As can be seen in FIGS. 3 and 5, the front faces 103 of upstanding walls 96, 98 are angled slightly inward toward the rear end 56 of the housing from the portion walls 86, 89 to the cap portion 94.

Figure 3A:
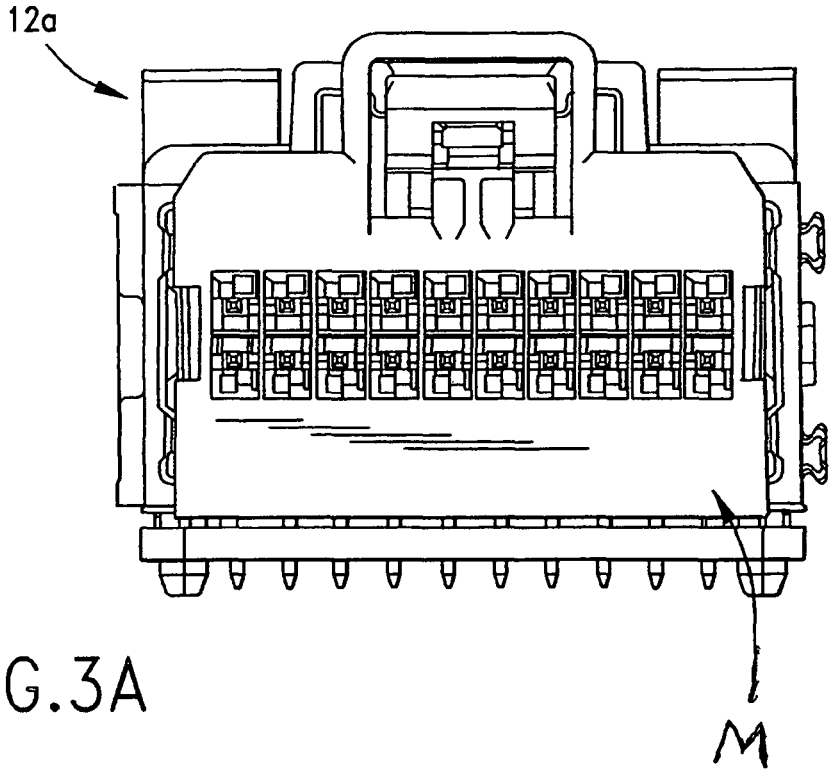
FIG. 3A is an elevation view of one embodiment of an interlocking modular header according to the present disclosure having a complementary mating connector connected thereto.
Figure 3B:
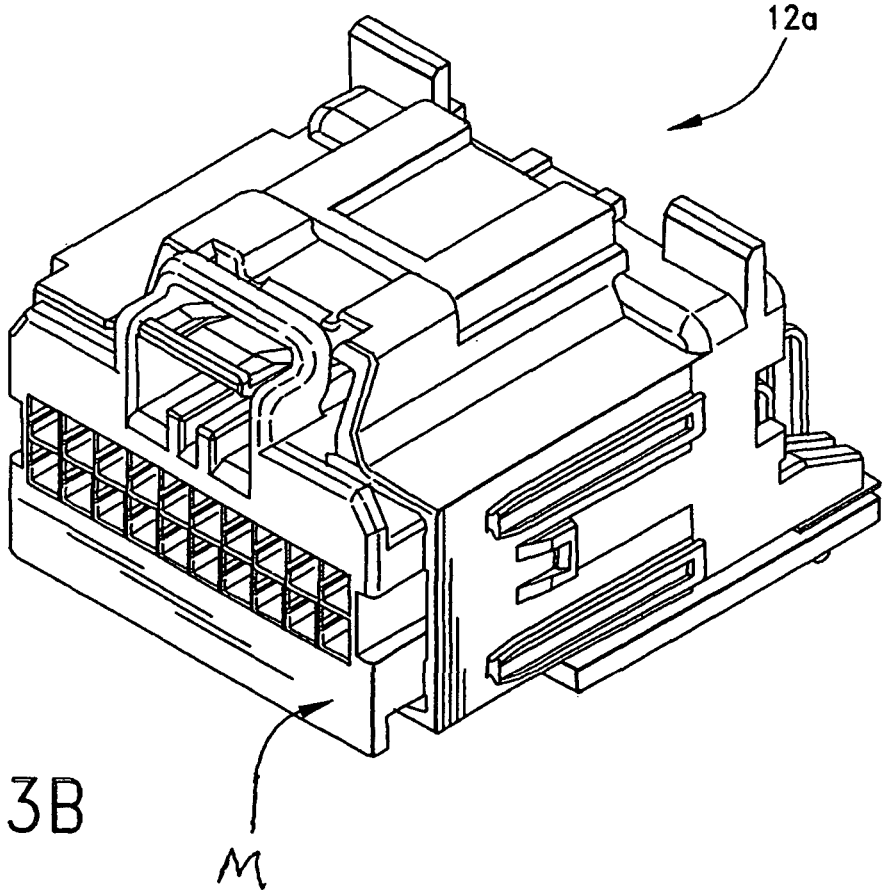
FIG. 3B is a perspective view of the interlocking header and complementary mating connector shown in FIG. 3A.
Figure 11A:
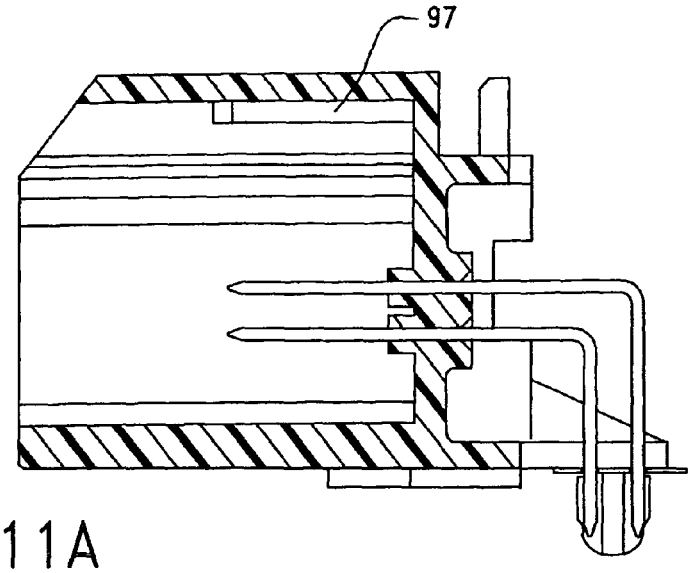
FIG. 11A is a cross-sectional view taken at line 11A shown in FIG. 11.

Upstanding walls 96, 98 can each have a rib 97 adjacent the interface with respective opposite ends of cap portion 94. Rib 97 can extend from rear wall 80 a partial distance toward front end 50 of housing 34*c* as shown in FIG. 11*a*. By not having rib 97 extend the entire longitudinal distance of upstanding walls 96, 98, and by having cap portion 94 include cut out portion 93, sound generated by the engagement of hook 91 to a biasing catch member 114 of a mating connector "M" (as shown in FIG. 2A) is muted less than if rib 97 extended fully and center area 95 extended fully. In other words, an echo chamber is formed in which sound is reflected and allowed to escape permitting the user to identify a proper engagement has occurred as shown in FIGS. 2A, 3A and 3B.

While the present disclosure has been described in detail with reference to the foregoing embodiments, other changes and modifications may still be made without departing from the spirit or scope of the present disclosure. It is understood that the present disclosure is not to be limited by the embodiments described herein. Indeed, the true measure of the scope of the present disclosure is defined by the appended claims including the full range of equivalents given to each element of each claim.

What is claimed is:

1. A plurality of side-by-side interconnectable modular connectors for receiving mating connectors, each modular connector comprising:

a housing having a front end and a rear end and a receiving cavity defined by a top wall, a bottom wall, a first sidewall, a second sidewall and a rear wall, each cavity having an opening positioned at the front end and a connector interface for mating with a complementary mating connector, said first sidewall including a first connecting structure and said second sidewall including a second connecting structure wherein engagement of the first connecting structure with the second connecting structure joins the modular connectors together, said first sidewall and said second sidewall each respectively forming an inner angle within the receiving cavity with respect to said rear wall, said first and second sidewall being parallel to each other with said inner angles of said first sidewalls being a predetermined amount greater than 90 degrees and said inner angles of said second sidewalls being said predetermined amount less than 90 degrees or said inner angles of said first sidewalls being a predetermined amount less than 90 degrees and said inner angles of said second sidewalls being said predetermined amount greater than 90 degrees.

2. A plurality of side-by-side interconnectable modular connectors as claimed in claim 1, wherein said inner angles of said first sidewalls are approximately 91 degrees and said inner angles of said second sidewalls are approximately 89 degrees.

3. A plurality of side-by-side interconnectable modular connectors as claimed in claim 1, wherein said inner angles of said first sidewalls are approximately 89 degrees and said inner angles of said second sidewalls are approximately 91 degrees.

4. An interconnecting modular connector, for side-by-side engagement with an other interconnecting modular connector, comprising: a housing having a front end and a rear end and a receiving cavity defined by a top wall, a bottom wall, a first sidewall, a second sidewall and a rear wall, the cavity having an opening positioned at the front end and a connector interface for mating with a complementary mating connector, said top wall including a first top portion extending inward at an angle of greater than ninety degrees from the first sidewall, a second top portion extending inward at an angle of greater than ninety degrees from the second sidewall, a first upward extending portion extending upward from the first top portion, a second upward extending portion extending upward from the second top portion and a ceiling extending generally parallel to the bottom wall and connecting the first upward extending portion and the second upward extending portion, said first upward extending portion and said second upward extending portion extending from the ceiling at an angle of greater than ninety degrees.

5. An interconnecting modular connector as claimed in claim 4, wherein the first top portion and the first upward extending portion meet at a first corner portion and the second top portion and the second upward extending portion meet at a second corner portion, and each of the first and second corner portions has a T-shape.

6. An interconnecting modular connector as claimed in claim 5, wherein each corner portion includes a slanted wall and a rib extending generally perpendicular from the center of the slanted wall and towards the receiving cavity.

7. An interconnecting modular connector as claimed in claim 6, wherein said top, bottom and rear walls extend between the first and second sidewalls, the rear wall is perpendicular to the bottom wall, the first and second sidewalls are parallel to each other and the outer angle between an outer surface of the first sidewall and a plane parallel to the rear wall is greater than ninety degrees and the outer angle between the outer surface of the second sidewall and the plane is less than ninety degrees.

8. An interconnecting modular connector as claimed in claim 7, wherein the ceiling includes a cutout portion adjacent the opening of the cavity.

9. An interconnecting modular connector as claimed in claim 8, wherein said ceiling includes a hook adjacent the cutout portion for engagement by a catch member carried by the mating connector.

10. An interconnecting modular connector as claimed in claim 8, wherein each of the first and second upward extending portions includes a rib extending from the rear wall approximately midway to the front end and positioned at the intersection of the respective upward extending portion and the ceiling.

11. An interconnecting modular connector as claimed in claim 7, wherein said first and second sidewalls include locking means for locking engagement with an adjacent connector.

12. A plurality of side-by-side interconnected modular connectors for receiving mating connectors, each modular connector comprising:

a housing having a front end and a rear end and a receiving cavity defined by a top wall, a bottom wall, a first sidewall, a second sidewall and a rear wall, each cavity having an opening positioned at the front end and a connector interface for mating with a complementary mating connector, each top wall including a first top portion extending inward at an angle of greater than ninety degrees from the first sidewall, a second top portion extending inward at an angle of greater than ninety degrees from the second sidewall, a first upward extending portion extending upward from the first top portion, a second upward extending portion extending upward from the second top portion and a ceiling extending generally parallel to the bottom wall and connecting the first upward extending portion and the second upward extending portion, each first upward extending portion and each second upward extending portion extending from the ceiling at an angle of greater than ninety degrees.

13. A plurality of side-by-side interconnected modular connectors as claimed in claim 12, wherein each first top portion and each first upward extending portion meet at a first corner portion and each second top portion and each second upward extending portion meet at a second corner portion, and each of the first and second corner portions has a T-shape.

14. A plurality of side-by-side interconnected modular connectors as claimed in claim 13, wherein each corner portion includes a slanted wall and a rib extending generally perpendicular from the center of the slanted wall and towards the receiving cavity.

15. A plurality of side-by-side interconnected modular connectors as claimed in claim 14, wherein each top, bottom and rear wall extends between its respective first and second sidewalls, each rear wall is perpendicular to its respective bottom wall, all first and second sidewalls are parallel to each other and each outer angle between an outer surface of each first sidewall and a plane parallel to each rear wall is greater than ninety degrees and each outer angle between an outer surface of each second sidewall and the plane is less than ninety degrees.

16. A plurality of side-by-side interconnected modular connectors as claimed in claim 15, wherein each ceiling includes a cutout portion adjacent the mouth of the cavity.

17. A plurality of side-by-side interconnected modular connectors as claimed in claim 16, wherein each ceiling includes a hook adjacent the cutout portion for engagement by a catch member carried by the mating connector.

18. A plurality of side-by-side interconnected modular connectors as claimed in claim 16, wherein each of the first and second upward extending portions includes a rib extending from the respective rear wall approximately midway to the front end and positioned at the intersection of the respective upward extending portion and the ceiling.

19. A plurality of side-by-side interconnected modular connectors as claimed in claim 15, wherein each first and second sidewall includes locking means for interlocking engagement with an adjacent connector.

20. A plurality of side-by-side interconnected modular connectors as claimed in claim 15, wherein each of the connector interfaces includes one of either a set of terminal connectors, a USB connector, coaxial connector, or RF connector, or fiber optic connector.

21. A plurality of side-by-side interconnected modular connectors as claimed in claim 20, wherein each of the housings is colored to distinguish among various types of connectors.

22. A plurality of side-by-side interconnected modular connectors as claimed in claim 19, wherein said locking means includes a first locking member and one of a pair of parallel tongues or a pair of parallel grooves, each groove having a stop, formed on said first sidewall, and a second locking member and the other of said pair of parallel tongues or said pair of parallel grooves, each groove having a stop, formed on said second sidewall, wherein the sliding engagement of the pair of tongues respectively within the pair of grooves joins the modular connectors together and engages the first and second locking members and wherein the stops halt the progression of the tongues within the grooves and prevent sliding disengagement in one direction and engagement of the first and second locking members prevent sliding disengagement in the opposite direction to lock the joined modular connectors to each other.

23. A plurality of side-by-side interconnected modular connectors as claimed in claim 22, wherein said locking members are respectively positioned in between and generally midway along the length of the pairs of parallel tongues and parallel grooves.

* * * * *